US007267809B2

(12) United States Patent
Ranke et al.

(10) Patent No.: US 7,267,809 B2
(45) Date of Patent: Sep. 11, 2007

(54) BURNER AND METHOD FOR THE CHEMICAL REACTION OF TWO GAS STREAMS

(75) Inventors: Harald Ranke, Poecking (DE); Michael Heisel, Pulach (DE); Sebastian Muschelknautz, Munich (DE); Hanno Tautz, Munich (DE)

(73) Assignee: The Linde Group, Pullach (DE)

( * ) Notice: Subject to any disclaimer, the term of this patent is extended or adjusted under 35 U.S.C. 154(b) by 623 days.

(21) Appl. No.: 10/432,775

(22) PCT Filed: Oct. 18, 2001

(86) PCT No.: PCT/EP01/12058

§ 371 (c)(1),
(2), (4) Date: Nov. 4, 2003

(87) PCT Pub. No.: WO02/42686

PCT Pub. Date: May 30, 2002

(65) Prior Publication Data

US 2004/0067461 A1 Apr. 8, 2004

(30) Foreign Application Priority Data

Nov. 27, 2000 (DE) ..... 100 58 875
Feb. 26, 2001 (DE) ..... 101 09 266

(51) Int. Cl.
*C01B 17/04* (2006.01)
*C01B 31/02* (2006.01)
*F23D 14/00* (2006.01)

(52) U.S. Cl. ..... 423/449.1; 423/450; 423/576.8; 431/9; 431/181; 431/182; 431/183; 431/184; 431/185; 239/403; 239/404; 239/406; 239/416.5; 239/424

(58) Field of Classification Search ..... 431/9, 431/181–185; 239/403, 404, 406, 416.5, 239/424; 423/576.8, 449.1, 450
See application file for complete search history.

(56) References Cited

U.S. PATENT DOCUMENTS

| | | | | |
|---|---|---|---|---|
| 4,970,059 | A * | 11/1990 | Schaefer et al. | 423/450 |
| 4,988,287 | A | 1/1991 | Stegelman et al. | |
| 5,492,649 | A * | 2/1996 | Christensen | 252/372 |
| 5,496,170 | A | 3/1996 | Primdahl et al. | |
| 5,752,663 | A * | 5/1998 | Fischer et al. | 239/424 |
| 6,029,910 | A | 2/2000 | Joshi et al. | |
| 6,123,542 | A | 9/2000 | Joshi et al. | |
| 6,391,274 | B1 * | 5/2002 | Vogler et al. | 423/275 |
| 2006/0231645 | A1 * | 10/2006 | Chan | 239/424 |

FOREIGN PATENT DOCUMENTS

| | | |
|---|---|---|
| DE | 363452 | 11/1922 |
| EP | 0 999 411 A2 * | 5/2000 |
| WO | WO9939833 | 8/1999 |

* cited by examiner

*Primary Examiner*—Timothy C. Vanoy
(74) *Attorney, Agent, or Firm*—Millen, White, Zelano & Branigan, P.C.

(57) ABSTRACT

The invention relates to a burner with a burner head (1) and a gas feed pipe (2) that is located in the burner head (1) and that is surrounded by an ring channel (3) for feed of another gas. In the gas feed pipe (2) and in the ring channel (3), there are means (10, 11) for producing a swirl of the gas flowing through the gas feed pipe (2) and that flowing through the ring channel (3).

29 Claims, 1 Drawing Sheet

BURNER AND METHOD FOR THE CHEMICAL REACTION OF TWO GAS STREAMS

The invention relates to a burner with a burner head and a gas feed pipe that is located in the burner head and that is surrounded by a ring channel for feed of another gas, in the gas feed pipe and in the ring channel there being means for producing a swirl of a gas flowing through the gas feed pipe or a gas flowing through the ring channel. Furthermore, the invention relates to a process for producing a reaction product by chemical reaction of gases that are supplied to a reaction space by means of a burner as two separate gas streams and are chemically reacted in the reaction space.

When a combustible gas is burned with an oxygen-containing gas in an outside-mixing burner, i.e. in burners in which the combustible gas and the oxygen-containing gas are not premixed, but are routed separately into the mixing zone and are ignited there, it is important to achieve intensive intermixing of the oxygen-containing gas and combustible gas in order to accelerate the chemical combustion reaction between these gases.

In U.S. Pat. No. 5,492,649, it is therefore proposed that a swirl be impressed on the oxygen-containing gas before entering the mixing zone. In this process, a recirculation zone forms as the oxygen-containing gas is highly swirled in front of the exit opening of the oxygen-containing gas. In other words: with strong rotary momentum of the oxygen-containing gas, the latter has a flow profile in which in the vicinity of the flow axis, the flow direction is reversed and backflow forms. Intensive turbulence that promotes the chemical reaction between the combustible gas and the oxygen-containing gas results from the steep velocity gradient in the transition area between the forward flow and the backflow.

Within the framework of extensive studies preceding this invention, it has been found, however, that the backflow in the axial area also takes in hot reaction gases that then travel to the exit opening of the feed pipe for the oxygen-containing gas. The hot reaction gases attack the gas feed pipe so that the feed pipe is damaged.

The object of this invention is therefore to develop a burner and a process for chemical reaction of gases, damage to the burner being avoided as much as possible and the chemical reaction taking place as efficiently and in as defined a manner as possible.

This object is achieved by a burner of the initially mentioned type, in which the wall of the gas feed pipe runs to an acute angle on its exit end and the means for producing a swirl in the gas feed pipe or the ring channel is set back upstream against the exit end by 0.1 to 10 times, preferably by 0.5 to 5 times, and especially preferably by 0.5 to 2 times the outside diameter of the means for producing a swirl.

Damage to the burner tip can essentially be attributed to the backflow of hot gases. It has been found that one of the reasons for such backflows lies in the execution of the exit end of the gas feed pipe. According to the invention, the wall of the gas feed pipe runs out to an acute angle on the exit end, i.e., its wall thickness gradually diminishes to a value of almost zero.

This embodiment greatly reduces the danger of separation of the gas streams emerging from the gas feed pipe and the ring channel in the area of the exit end of the gas feed pipe. The flow filaments do not detach at the exit end of the gas feed pipe and do not cause eddies that can lead to unwanted heat delivery to the burner tip.

For highly varied velocities of the gases supplied via the gas feed pipe and via the ring channel, however, eddies can still separate. This adverse effect also occurs when the speed of one of the participating gases is changed, as can occur, for example, when the load changes.

It has now been shown that the flow in the use of swirl bodies according to the invention, i.e., the means for producing a swirl, in the gas feed pipe and the ring channel breaks away in part on the exit end of the gas feed pipe and eddies form. Studies have shown that the component of rotary motion that has been impressed on the gas streams as swirling is produced directly following the swirl bodies and has in alternation areas with higher velocity and areas with lower velocity. That is, tangentially to the direction of primary flow of the gas, gas velocity peaks and valleys periodically occur. These velocity changes on the exit end of the gas feed pipe are causally responsible for the unwanted flow separation.

Therefore, according to the invention, the means for producing a swirl are set back relative to the exit end of the gas feed pipe, i e., are located upstream from it. The distance to the exit opening is between 0.1 and 10 times, preferably between 0.5 and 5 times, and especially preferably between 0.5 and 2 times the inside diameter of the gas feed pipe. A distance from 1.5 to 2.5 of the outside diameter of the swirl generation means has proven quite especially effective. In this way, the above-described periodic velocity changes are equalized and on the exit end a flow profile forms with an essentially constant peripheral speed. The swirl generation means in the ring channel are likewise set back relative to the exit opening of the ring channel. Here, a distance from 0.5 to 1 times the outside diameter of the swirl generation means that is located in the ring channel has proven favorable.

A process of the initially mentioned type for chemical reaction of gases is characterized according to the invention in that before entering the reaction space, a swirl flow is impressed on the gas streams in each case, i.e., the gas streams also have a component of rotary motion around the direction of their main flow upon entering the reaction space, in addition to the essentially axial component of motion.

The additional swirling of the gas supplied via the ring channel according to the invention leads to intensive radial mass exchange between the two gas streams and thus to rapid mixing. The inner jet is focussed by the outer jet that is widened conversely by the inner jet. This strong interaction between the two jets causes intensive and rapid mixing.

In the overall jet in the region of the burner, in this case backflow zones do not form, so that hot reaction gas is largely kept away from the gas feed pipe. Only the relatively cold, not yet reacted gases come into direct contact with the gas feed pipe. Damage to the gas feed pipe by convection is prevented.

The invention allows exactly definable mixing of the participating gas streams. In the reaction space in which the chemical reaction is to take place, the temperature, flow and gas composition conditions can be matched to the desired chemical reactions. The widening of the flame that forms in the reaction of the two gas streams can be adjusted via the strength of the two swirl flows within wide limits. The shape of the flame can be made as desired by the swirl flow according to the invention. Thus, optimum matching to the size of the reaction space is possible. Furthermore, the dwell time in the reaction space can be optimized by suitable choice of flow guidance.

The swirling of the two jets involved in the reaction can take place such that the two swirl flows are aligned in the same direction or in opposite directions. Swirling in opposite directions, i.e., swirling in which the swirl flows of the two gas streams in the contact area of the two gas streams are pointed in opposite directions to one another, has the advantage that the gas streams are mixed very vigorously with one another. The chemical reaction is accelerated, i.e., rapid, early ignition of the reaction mixture of gases takes place. Swirling of the overall jet that forms after combination of the gas streams is conversely relatively low, since the swirling of the reaction jets in opposite directions partially cancels the two original swirl flows. The resulting flame thus widens relatively little.

Preferably, the individual swirl flows are aligned such that they run in the same direction. In this case, the swirl flows intensify in the contact area of the two gas streams, so that a relatively high total swirl number is reached. This results in dramatic widening of the overall jet. The speed along the jet axis decreases in the combustion zone. Based on the reduced jet speed, the dwell time of the reactants in the reaction space increases compared to the known reaction guides in which at most one of the participating gas streams is swirled.

Moreover, with a suitable swirl intensity, a backflow relatively far away from the burner tip can be produced. This leads to a circulation flow by which the gases remain longer in the reaction space and are thus better reacted. In particular, for slow chemical reactions, complete reaction of the gas streams is achieved in this way.

The flame topology can be adjusted especially well for swirling in the same direction. The axial length and radial extension of the flame can be chosen and can be matched both to the reaction space and also to the reaction conditions. Moreover, the mixing of the two gas streams in the vicinity of the burner tip is not as intense as in the swirling of the jets in opposite directions, so that the thermal load on the burner tip is reduced.

Swirling in the same direction, moreover, has the advantage that at the desired total swirl number, the swirl of one of the two gas streams can be chosen to be lower than is possible in swirling in opposite directions or in the known swirling of only one stream.

In the swirling of a gas stream, the gas stream necessarily undergoes a certain pressure loss. This pressure loss must be kept as low as possible especially when the pertinent gas stream is available only under low pressure. Under these circumstances it is advantageous if the gas stream under lower pressure is swirled less; the gas stream under higher pressure is conversely swirled more strongly. The swirling of the two streams in the same direction thus makes it possible to achieve the desired total swirl number.

The gas feed pipe is preferably made such that its inside diameter and/or its outside diameter decreases in the area of the exit end. By changing the inside diameter, the flow velocity of the gas in the gas feed pipe can be influenced. The outside diameter especially preferably approaches the inside diameter in the vicinity of the exit opening from the gas feed pipe so that a sharp edge forms directly at the exit opening. On the sharp edge, the gas streams emerging from the gas feed pipe and from the surrounding ring channel break away in a defined manner, by which unwanted eddies and turbulence are prevented.

The outside wall of the ring channel is advantageously tilted in the area of the exit end in the flow direction of the burner axis. In this way, the gas flowing in the ring channel meets at a certain angle the gas emerging centrally from the gas feed pipe, by which the mixing of the two gas jets is promoted.

It has proven advantageous for the outside wall of the ring channel in the flow direction to extend beyond the exit end of the gas feed pipe. Damage to the gas feed pipe is, as mentioned, caused, on the one hand, by convection of the hot gases, but, on the other hand, also by heat radiation of the hot reaction gases. By pulling the outside wall of the ring channel forward beyond the exit opening of the gas feed pipe, the angular area visible from the exit opening of the gas feed pipe is reduced. In this way, the conical area from which radiant heat can travel directly to the gas feed pipe is made smaller, and the thermal load on the gas feed pipe is reduced.

Preferably, the gas streams supplied via the gas feed pipe and the ring channel are combined at a certain angle to improve mixing of the streams. After the two streams meet, the outer stream is widened by the central stream. The outer stream supplied by the ring channel thus moves first toward the burner axis and then away from the burner axis. If this change of direction takes place too quickly, eddies can occur that can lead to backflow of hot gases to the gas feed pipe. Preferably, therefore, an annular guide sleeve adjoins the ring channel in the flow direction; its outside wall runs essentially parallel to the burner axis. The outer stream is thus deflected more gently, specifically from the original direction to the burner axis into a direction parallel to the burner axis and only then away from the burner axis.

Advantageously, the ring channel or annular guide sleeve adjoins the mixing chamber with an inside diameter that increases in the flow direction. The flames are kept together by the latter, and combustion is promoted.

It is advantageous if the means for producing a swirl in the gas feed pipe and/or in the ring channel have flow channels that are tilted tangentially against the flow direction. One such execution of the means for generating a swirl can be easily produced, for example the channels can be bevelled. The swirling of the stream can be easily dictated via the angle of the flow channels. The swirling can also be produced via appropriately aligned baffle plates, guide vanes or blades in the ring channel and/or the gas feed pipe. This execution is to be preferred especially when the pressure loss that occurs due to swirling is to be minimized.

Preferably the means for producing a swirl in the gas feed pipe and/or in the ring channel can be adjusted so that swirl flows of different intensity can be produced. The flow conditions can be adapted to the supplied amounts of gas and the chemical reaction underway by a suitable choice of the swirl number, i.e., the intensity of swirling, of the participating gas streams. The load area of the burner can be adjusted in this way and especially can be enlarged.

Depending on the execution of the means for producing a swirl in the gas feed pipe, in addition to the desired swirl, more or less strong backflow at the end of this swirl generation means is formed. This backflow can lead to hot reaction gases being sucked towards the burner tip and damaging it. It has therefore proven advantageous to provide the swirl generation means in the gas feed pipe with a central hole. As a result of this hole, the central flow filament passes through the swirl generation means unhindered into the gas feed pipe. Backflow that forms on the end of the swirl generation means is overcompensated by the central gas flow that runs essentially in a straight line. Downstream from the swirl generation means, in this way, a swirl flow forms that does not have flow components pointed backward in the center in the vicinity of the burner head. Damage to the burner tip is thus prevented especially effectively.

Preferably means for supply with an oxygen-containing gas, especially pure oxygen, are connected to the gas feed pipe and means for supply with a combustible gas are connected to the ring channel. Feed of an oxygen-containing gas by the ring channel and a combustible gas by the gas feed pipe is also advantageous, however. In this case, means for supply with a combustible gas are connected to the gas feed pipe, and means for supply with an oxygen-containing gas, especially pure oxygen, are connected to the ring channel.

In a preferred embodiment, there is a blade that stabilizes the gas flow in the gas feed pipe and/or the ring channel. At high differential speeds between the two gas streams in the end area of the line, either the gas feed pipe or the ring channel through which a slower gas stream flows, eddies can form that can cause damage to the burner tip. Preferably, therefore, in the line in which the lower flow velocity prevails, a blade must be mounted that stabilizes the flow. The blade is made such that the flow velocity in the forming channel is increased between the wall separating the gas feed pipe and the ring channel and the blade.

The blade is advantageously set back against the exit end of the gas feed pipe or of the ring channel. This has the advantage that the blade is located completely within one of the two gas streams. The gas stream cools the blade especially on its downstream end and prevents the hot reaction mixture of the two gas streams from coming into contact with the blade.

There are advantageously different flow velocities for the two participating gas streams, since in this way mixing of the two gas streams is promoted. It has proven advantageous if the flow velocities of the gases differ by at least 10%, preferably at least 20%.

The absolute flow velocities are preferably between 30 and 200 m/s, especially preferably between 70 and 150 m/s, depending on the flame speed of the gas in the current state. It has been shown that at these speeds the flow conditions following the burner exit can be adjusted especially easily via the swirl number.

The ratio of the sum of the amounts of tangential pulses to the sum of the axial pulses defines the total swirl number. This influences, among others, the jet widening and thus represents the deciding parameter via which flame guidance and the dwell time of the gases in the reaction space can be controlled. Preferably, the total swirl number is set such that it is between 0.1 and 1.2, preferably between 0.2 and 0.7.

The burner according to the invention is especially suited for defined chemical reaction of gaseous parent materials into a reaction product. The preferred use of the burner is primarily not to generate heat, but rather to carry out a defined chemical reaction of two or more gaseous parent substances. The gases can be optimally mixed in exactly definable ranges by the double swirling. Here, the widening of the flame that forms after the exit of the gases from the burner and the dwell time of the gases in the reaction space can be adjusted within wide limits and can be adapted to the chemical reaction. The flame can thus be optimally matched to the reaction space. The temperature in the reaction space and the velocity distributions of the participating gases can be computed and matched to the desired process behaviors. The kinetics of the chemical reaction can be influenced.

In this respect, the process according to the invention has proven effective especially in the chemical reaction of an oxygen-containing gas with a hydrogen sulfide-containing gas, with halogenated hydrocarbons or pyrolysis oils or with low-calorie substances. Especially in the gasification of hydrocarbons that are reacted at higher temperatures with oxygen or an oxygen-containing gas, the efficiency of gasification is clearly increased. Basically the invention is advantageous in all chemical reactions that are to proceed as near as possible to chemical equilibrium.

The invention and other details of the invention are explained in more detail below using the embodiments shown in the drawings. Here:

Figure 1:
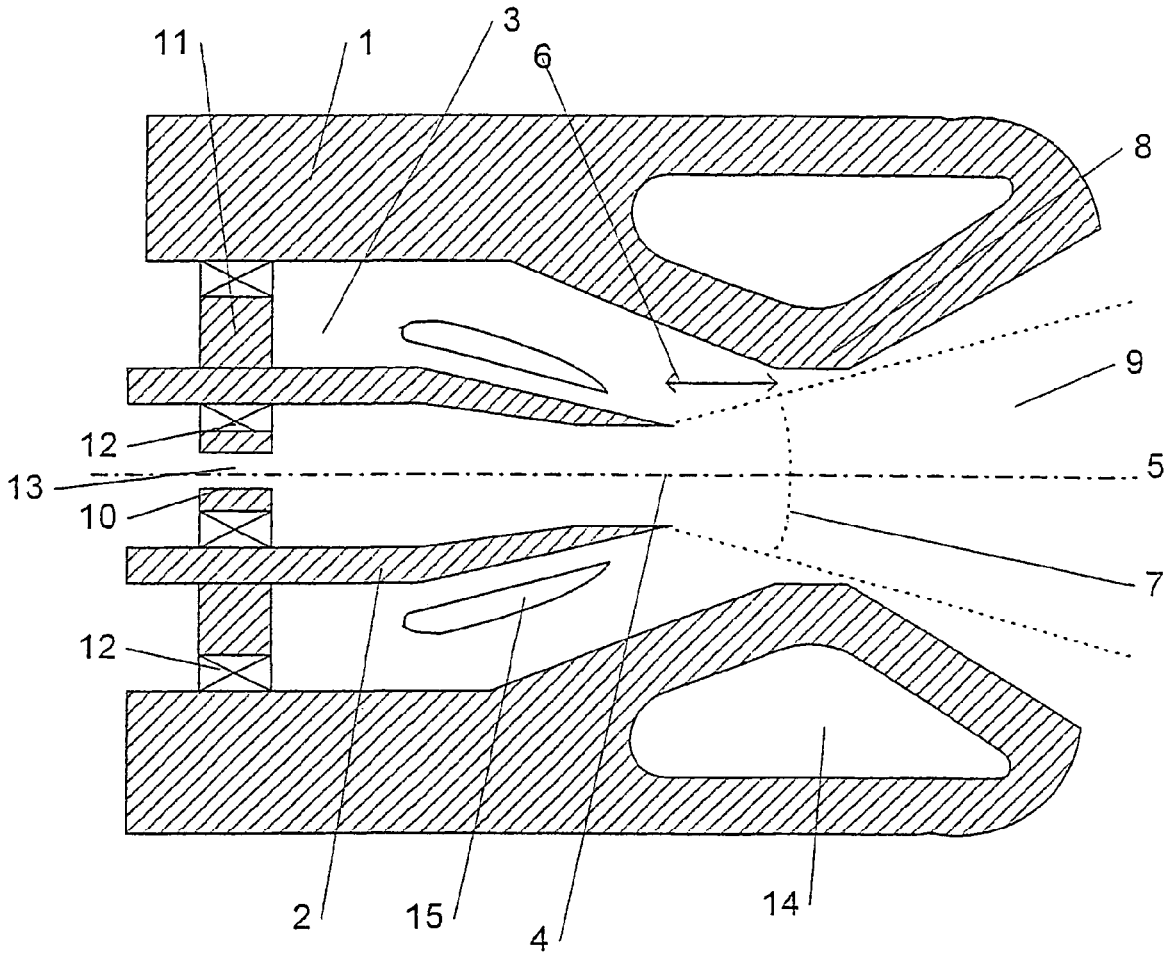
FIG. 1 shows a section through a burner head according to the invention.

The burner shown in FIG. 1 has a burner head 1 with a central hole in which a gas feed pipe 2 is located. The gas feed pipe 2 is connected to an oxygen supply that is not shown. The gas feed pipe 2 is surrounded by a ring channel 3 to which a combustible gas supply that is not shown in the figure either is connected. The burner head 1 is furthermore provided with a cooling channel 14 for guiding a coolant, preferably water.

The gas feed pipe 2 that is used as the oxygen delivery line runs slightly conically to the end in the downstream end area, the inside diameter and the outside diameter of the pipe 2 decreasing. On the exit end 4, the wall of the pipe 2 runs out at an acute angle. The ring channel 3 is likewise tilted in the downstream end area against the burner axis 5. The outside wall of the ring channel 3 relative to the inside wall of the ring channel 3 and thus relative to the oxygen delivery line 2 is brought forward by a segment 6 with a length corresponding to the inside diameter of the gas feed pipe 2. In this way the angular range 7 that characterizes the "visual field" of the gas feed pipe 2 is made smaller, by which the radiant heat of the hot reaction gases acting on the gas feed pipe 2 is reduced.

The ring channel 3 adjoins a guide sleeve 8 with an outside wall that runs parallel to the burner axis 5. Downstream from the guide sleeve 8, the outside wall tilts away from the burner axis 5 and forms a mixing chamber 9 with an inside diameter that increases in the flow direction. The combustible gas flowing in the ring channel 3 is widened in burner operation by the central oxygen flow. The combustible gas is therefore delivered first to the burner axis 5 by the shaping of the ring channel 3 in order to flow away from the burner axis 5 after leaving the ring channel 3 in the mixing chamber 9 as a gas mixture with oxygen. The guide sleeve 8 ensures that the change of direction of the combustible gas takes place gently. The gradual deflection of the combustible gas stream prevents eddies and turbulence in front of the exit opening 4 that could result in backflow of hot gas.

Figure 2:
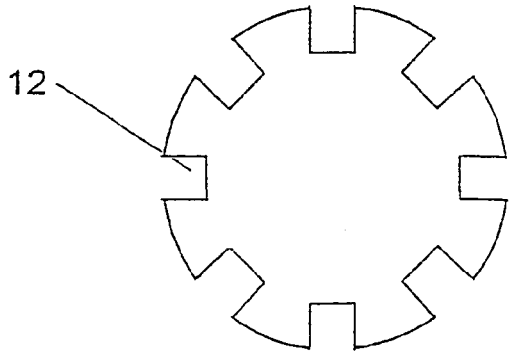
FIG. 2 shows a section through the swirl body used for producing a swirl in the gas flow in the gas feed pipe.

To improve intermixing of the combustible gas and the oxygen, there are swirl bodies 10, 11 located both in the oxygen delivery line 2 and also in the ring channel 3. The swirl bodies 10, 11 are set back relative to the exit opening 4 of the gas feed pipe 2. FIG. 2 shows an overhead view of the swirl body 10 in the flow direction. The swirl body 11 has, distributed over its periphery, several slotted channels 12 that run obliquely to the burner axis 5, i.e., they have an axial and a tangential directional component. The swirl body 10 has an analogous structure in the ring channel 3. A swirl flow is impressed on the combustible gas and oxygen by the slotted channels 12 and leads to improved mixing of the two gases in the mixing space 9.

In the ring channel 3, there are blades 15 that stabilize the gas flow. The blade 15 is made such that the flow velocity is increased in the channel that is forming between the wall that separates the gas feed pipe 2 and the ring channel 3 and the blade 15.

Using the example of a Claus reaction, the invention will be explained in detail once again. Claus systems are used to produce elementary sulfur from hydrogen sulfide-containing crude gas. The crude gas is burned substoichiometrically in a so-called Claus furnace so that sulfur dioxide and elementary sulfur are formed. The crude gas delivered to the Claus reaction generally also contains $NH_3$ must be essentially completely reacted in the Claus furnace to form $N_2$ and $H_2$ or $H_2O$. Otherwise, unreacted $NH_3$ reacts with $SO_2$ and $SO_3$ further to form heavy salts that then lead to shifting in the Claus system over time. In this connection, especially the catalysts in the Claus reactors and the sulfur condensers are endangered.

To reliably break down $NH_3$, a temperature of greater than 1200° C. is required, and it must be ensured that the $NH_3$ is also in fact exposed to this temperature. For this reason, it is advantageous to burn the crude gas with oxygen or oxygen-enriched air. This increases specifically the flame temperature, and decomposition of the $NH_3$ is promoted. In addition, very good intermixing of the gases in the flame must be ensured because otherwise the $NH_3$ could transverse the Claus furnace in part without having come into contact with the oxygen as the reaction partner or without passing through the area with a relatively high temperature. In both cases, the desired reaction into $N_2$ and $H_2/H_2O$ would not take place.

The burner according to the invention now enables defined intermixing of the crude gas with oxygen, relatively dramatic widening of the flame, so that in the entire Claus furnace, the necessary temperature conditions can be set, and the formation of the flow conditions in the furnace that lead to an optimum dwell time of the gases in the furnace. The almost complete reaction of $NH_3$ into $N_2$ and $H_2/H_2O$ is thus ensured.

The invention claimed is:

1. A burner comprising a burner head, a gas feed pipe located in the burner head, and a ring channel which surrounds the gas feed pipe for feed of another gas, means for producing a swirl of a gas flowing through the gas feed pipe, and the ring channel, wherein the wall of the gas feed pipe (2) runs to an acute angle on its exit end (4) and the means (10, 11) for producing a swirl in the gas feed pipe (2) or the ring channel (3) is set back upstream from the exit end (4) by 0.1 to 10 times the outside diameter of the means (10, 11) for producing a swirl.

2. A burner according to claim 1, wherein the means for producing a swirl located in the gas feed pipe has a hole that runs parallel to the burner axis.

3. A burner according to claim 1, wherein the inside diameter of the gas feed pipe (2) decreases in the area of the exit end.

4. A burner according to claim 1, wherein the outside diameter of the gas feed pipe (2) decreases in the area of its exit end.

5. A burner according to claim 1, wherein the outside wall of the ring channel (3) is tilted in the area of the exit end in the flow direction of the burner axis (5).

6. A burner according to claim 1, wherein the outside wall of the ring channel (3) extends in the flow direction beyond the exit end of the gas feed pipe (2).

7. A burner according to claim 1, wherein an annular guide sleeve (8) adjoins the ring channel (3) in the flow direction, and its outside wall runs essentially parallel to the burner axis (5).

8. A burner according to claim 7, wherein the annular guide sleeve (8) is adjoined by a mixing chamber (9) with an inside diameter that increases in the flow direction.

9. A burner according to claim 1, wherein the ring channel (3) or is adjoined by a mixing chamber (9) with an inside diameter that increases in the flow direction.

10. A burner according to claim 1, wherein the means (10, 11) for producing a swirl in the gas feed pipe (2) and/or in the ring channel (3) have flow channels (12) that are tilted tangentially against the flow direction.

11. A burner according to claim 1, wherein the means (10, 11) for producing a swirl in the gas feed pipe (2) and/or in the ring channel (3) are adjustable in order to produce swirl flows of varied velocity.

12. A burner according to claim 1, further comprising means for supplying an oxygen-containing gas, is connected to the gas feed pipe (2), and means for supplying a combustible gas is connected to the ring channel (3).

13. A burner according to claim 12, wherein said oxygen-containing gas is pure oxygen.

14. A burner according to claim 1, further comprising means for supplying a combustible gas is connected to the gas feed pipe (2), and means for supplying an oxygen-containing gas is connected to the ring channel (3).

15. A burner according to claim 14, wherein said oxygen-containing gas is pure oxygen.

16. A burner according to claim 1, further comprising a blade for stabilizing gas flow in the gas feed pipe (2) and/or the ring channel (3).

17. A burner according to claim 16, wherein the blade is set back against the exit end of the gas feed pipe (2) or of the ring channel (3).

18. A burner according to claim 1, wherein the means (10,11) is set back upstream from the exit end (4) by 0.5 to 5 times the outside diameter of the means (10,11).

19. A burner according to claim 1, wherein the means (10,11) is set back upstream from the exit end (4) by 0.5 to 2 times the outside diameter of the means (10,11).

20. A process for producing a reaction product by chemical reaction of gases that are supplied to a reaction space by means of a burner according to claim 1, as two separate gas streams and are chemically reacted in the reaction space, wherein a swirl flow is impressed on the two separate gas streams before entering the reaction space.

21. A process according to claim 20, wherein the swirl flows impressed on the two gas streams are in the same direction.

22. A process according to claim 20, wherein the flow velocities of the two gas streams differ by at least 10%.

23. A process according to claim 22, wherein the velocities of the 2 gas streams differ by at least 20%.

24. A process according to claim 20, wherein the total swirl number of the two swirl flows is between 0.1 and 1.2.

25. A process according to claim 20, wherein the flow velocities of the gas streams are between 15 and 200 m/s.

26. A process according to claim 25, wherein the flow velocities of the gas streams are between 70 and 150 m/s.

27. A process according to claim 20, wherein an oxygen-containing gas and a hydrogen sulfide-containing gas are chemically reacted.

28. A process according to claim 20, wherein halogenated hydrocarbons or pyrolysis oils are reacted with an oxygen-containing gas.

29. A process according to claim 20, wherein hydrocarbons are reacted with an oxygen-containing gas for producing carbon black.

* * * * *

UNITED STATES PATENT AND TRADEMARK OFFICE

CERTIFICATE OF CORRECTION

PATENT NO. : 7,267,809 B2
APPLICATION NO. : 10/432775
DATED : September 11, 2007
INVENTOR(S) : Michael Heisel It is certified that error appears in the above-identified patent and that said Letters Patent is hereby corrected as shown below:

On the title page, Assignee: reads "The Linde Group, Pullach (DE)" should read -- Linde Aktiengesellschaft, Wiesbaden (DE) --
Column 8, line 2, reads "or is adjoined" should read -- is adjoined --
Column 8, line 13, reads "gas, is connected" should read -- gas connected --
Column 8, line 15, reads "gas is connected" should read -- gas connected --
Column 8, line 19, reads "gas is connected" should read -- gas connected --
Column 8, line 21, reads "gas is connected" should read -- gas connected --

Signed and Sealed this

Nineteenth Day of May, 2009

John Doll

JOHN DOLL
*Acting Director of the United States Patent and Trademark Office*